US006898387B2

(12) United States Patent
Kawamura

(10) Patent No.: US 6,898,387 B2
(45) Date of Patent: May 24, 2005

(54) IMAGE PROCESSING APPARATUS AND IMAGE PROCESSING METHOD

(75) Inventor: Takuya Kawamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 10/423,953

(22) Filed: Apr. 28, 2003

(65) Prior Publication Data

US 2003/0202812 A1 Oct. 30, 2003

(30) Foreign Application Priority Data

Apr. 30, 2002 (JP) ..... 2002-128436

(51) Int. Cl.[7] ..... G03G 15/20

(52) U.S. Cl. ..... 399/67; 399/45; 399/46; 399/68

(58) Field of Search ..... 399/45, 46, 67, 399/68, 69, 70, 322, 389

(56) References Cited

U.S. PATENT DOCUMENTS 6,112,037 A * 8/2000 Nagata et al. ..... 399/45

6,377,763 B2 * 4/2002 Sato ..... 399/49

FOREIGN PATENT DOCUMENTS

| | | |
|---|---|---|
| JP | 5-333728 | 12/1993 |
| JP | 6-90334 | 3/1994 |
| JP | 2001-92213 | 4/2001 |

* cited by examiner

*Primary Examiner*—Hoang Ngo
(74) *Attorney, Agent, or Firm*—Fitzpatrick, Cella, Harper & Scinto

(57) ABSTRACT

An image processing apparatus is capable of determining the optimal fixing condition taking the local toner distribution (toner density) into consideration from image data. The toner amount is obtained for a local area formed by a marked pixel and the surrounding pixels per color component signal, and the toner amount of each local area is added. Further, over the image data entirely, the toner amount of local area is worked out in plural local areas. Then, a toner amount that indicates the maximum value is acquired from the toner amount of plural local areas. On the bases of the toner amount in the local area that indicates the maximum value and the kind of sheet on which toner is fixed, the fixing speed is controlled optimally.

36 Claims, 9 Drawing Sheets

5001 5002 5003

| 5004 | TONER AMOUNT≦TLth1 | TLth1<TONER AMOUNT≦TLth2 | TLth2<TONER AMOUNT |
|---|---|---|---|
| 5005 PLAIN PAPER | EQUAL SPEED | EQUAL SPEED | EQUAL SPEED |
| 5006 BOARD PAPER | EQUAL SPEED | EQUAL SPEED | 2/3 SPEED |
| 5007 SPECIAL PAPER | EQUAL SPEED | 2/3 SPEED | 1/3 SPEED |
| 5008 OHT | 2/3 SPEED | 1/3 SPEED | 1/3 SPEED |

| | | | | |
|---|---|---|---|---|
| PL1v | PL2v | PL3v | PL4v | PL5v |
| PL6v | PL7v | PL8v | PL9v | PL10v |
| PL11v | PL12v | PLnv (n=13) | PL14v | PL15v |
| PL16v | PL17v | PL18v | PL19v | PL20v |
| PL21v | PL22v | PL23v | PL24v | PL25v |

FIG. 8

| | TONER AMOUNT≦TLth1 (5001) | TLth1<TONER AMOUNT≦TLth2 (5002) | TLth2<TONER AMOUNT (5003) |
|---|---|---|---|
| PLAIN PAPER (5005) | EQUAL SPEED | EQUAL SPEED | EQUAL SPEED |
| BOARD PAPER (5006) | EQUAL SPEED | EQUAL SPEED | 2/3 SPEED |
| SPECIAL PAPER (5007) | EQUAL SPEED | 2/3 SPEED | 1/3 SPEED |
| OHT (5008) | 2/3 SPEED | 1/3 SPEED | 1/3 SPEED |

(5004)

MEMORY MAP

IMAGE PROCESSING APPARATUS AND IMAGE PROCESSING METHOD

BACKGROUND OF THE INVENTION

1. Field of the Invention

The present invention relates to an image processing apparatus capable of controlling fixing conditions to fix toner on a sheet for processing multi-valued or binary image data. The invention also relates to an image processing method.

2. Related Background Art

For example, for an image processing apparatus, such as a color copying machine or color printer of electrophotographic method, there has been proposed printing on various kinds of paper sheets. There are, for example, board sheet, and OHT (Overhead Transparency), and further, those specially treated paper sheets, such as label sheets or sealing sheets. These sheets are different from a plain sheet in thermal conductivity, and in many cases, there is a need for more amount of heat for them than the plain sheet to execute fixing. The difference in amounts of heat needed for fixation is particularly conspicuous in a case of the color-printing engine that uses various toners.

Now, therefore, in order to give more amount of heat to a specially treated paper when fixing is executed, there have been known a method for increasing the amount of heat to be generated by a fixing device per unit time, and a method for reducing the speed at which the paper sheet passes a fixing device. Since the former allows the power dissipation to be increased, the latter is more often adopted in general. For example, it is practiced to enable an image processing apparatus to control the fixing conditions in accordance with the kinds of sheets on which toners are fixed.

However, when the fixing speed is determined depending only on the kind of sheet, it becomes necessary to reduce the fixing speed needed for an OHT to a ¼ of the fixing speed of a plain sheet. As compared with fixing toner for the plain sheet, the fixing toner for the OHT requires a larger amount of heat, and the printing productivity of the OHT is uniformly reduced corresponding to the kinds of sheets unavoidably.

In order to avoid the reduction of the printing productivity, if an amount of heat is given good enough for fixation without reducing the fixing speed, it is required for an image processing apparatus to consume an extremely large amount of electric power. It is not one of many optimum selections for an image processing apparatus to increase power dissipation even from the viewpoint of energy saving.

It is known that the amount of heat needed for fixation depends on the amount of toner on a sheet. The lesser the amount of toner, the smaller is the amount of heat that enables fixing to be executed. Also, the more the amount of toner, the larger is the amount of heat needed for the execution of fixing.

With the aforesaid relations between the toner amount and the heating amount needed for fixation, if the amount of toner is smaller, it should be possible to materialize fixing of toner without reducing the fixing speed actually even for a kind of paper sheet having unfavorable fixing capability, such as the OHT.

For fixing toner under the optimal fixing condition, it is necessary to acquire the amount of toner to be transferred to a sheet. Now, as a method for acquiring the fixing condition under which toner is fixed to a sheet, it is conceivable to work out a method for acquiring the fixing condition in accordance with the sum of the toner amounts used for one recording sheet, which has been obtained from image data.

However, in a case given below, it is not necessarily optimum that the fixing condition is determined on the bases of the sum of toner amounts used for one-sheet portion of a recording sheet. For example, such case is that the image data contain a mixture of characters and images to be represented on a recording sheet. In the case of the image data that contain characters and images, toners are biased to exist more often on the image portions. When the fixing condition is determined on the bases of the sum of toner amounts used for the one-sheet portion of a recording sheet, there is a possibility that the required amount of heat is not given sufficiently for the image portions.

In other words, if the toner distribution is biased for one-sheet portion of a recording sheet, it is not adequate from the viewpoint of the fixing capability of toner to the sheet that the fixing condition is determined on the bases of the sum of toner amounts used for one-sheet portion of the recording sheet.

Also, as another method for acquiring the fixing condition under which toner is fixed to a sheet, it is conceivable to acquire the fixing condition in accordance with the toner amount per pixel of the marked pixels that have been obtained from the image data. This method, however, may preset a case where the fixing condition thus acquired necessitates the supply of heat amount more than necessary for fixing toner.

For example, in a printer that processes multi-valued image data, if the density of a specific pixel is higher conspicuously than that of those surrounding it, the condition tends to be determined so as to supply heat in an amount needed for such one particular pixel. However, if the amount of toner needed for the pixels surrounding such one particular pixel is sufficiently small, the actually needed amount of heat for such particular pixel may be in some cases smaller than the thus acquired amount of heat, owing to the thermal conduction from the portions of the fixing device that corresponds to the surrounding pixels.

In other words, when the amount of heat needed for fixation is determined in accordance with the toner amount needed for one specific pixel, there may be present a case where heat is supplied in a wasteful amount eventually, and in terms of low power dissipation, the result may turn out to be unfavorable in some cases.

Also, in the case of color images, the toner amount may exert different influences given to fixing regarding toner of each color. For example, if the image processing apparatus is structured to use two-component toner for M, C, and Y, and one-component toner only for K, there may be encountered a problem that influences given to fixing are different per color, because the structure of each toner is different, among some others.

SUMMARY OF THE INVENTION

With a view to solving the problems discussed above, the present invention is designed. It is an object of the invention to provide an image processing apparatus capable of determining the optimal fixing condition by acquiring the distribution (density) of local toner amount from image data to calculate of the amount of heat needed for fixation, and also to provide an image processing method. Further, it becomes possible to provide an image processing apparatus capable of enhancing the printing productivity of sheets other than the plain paper sheet, such as board paper (thick paper) and OHT, and also to provide an image processing method.

One embodiment of the invention is an image processing apparatus for processing image data formed by plural color components, which comprises first calculating means for calculating the toner amount for a local area formed by a marked pixel and surrounding pixels per color component data; second calculating means for calculating the toner amount for the local area with respect to the image data by adding the toner amounts for the local area calculated by the first calculating means for respective colors; third calculating means for calculating the toner amount for a local area indicating the maximum toner amount following the execution of calculations by the first calculating means and the second calculating means in plural local areas with respect to the image data; and determining means for determining a fixing speed for fixing toner on a sheet in accordance with the result of calculation of the third calculating means.

Also, the third calculating means calculates, in the local areas over the image data entirely, the toner amount for the local area indicating the maximum toner amount following the execution of calculations by the first calculating means and the second calculating means.

Also, when the second calculating means calculates the toner amount in the local area, weighting is effectuated per color component.

Also, another embodiment of the invention is an image processing apparatus for processing image data formed by plural color components, which comprises first calculating means for calculating the toner amount for a local area formed by a marked pixel and surrounding pixels per color component data; second calculating means for calculating the toner amount for the local area with respect to the image data by adding the toner amounts for the local area calculated by the first calculating means for respective colors; third calculating means for calculating the toner amount for a local area indicating the maximum toner amount following the execution of calculations by the first calculating means and the second calculating means in plural local areas with respect to the image data; and determining means for determining a fixing speed for fixing toner on a sheet in accordance with the result of calculation of the third calculating means and the material information of the sheet.

Also, the third calculating means calculates, in the local areas over the image data entirely, the toner amount for the local area indicating the maximum toner amount following the execution of calculations by the first calculating means and the second calculating means.

Also, when the second calculating means calculates the toner amount in the local area, weighting is effectuated per color component.

Also, still another embodiment of the invention is an image processing method for processing multi-valued image data formed by plural color components, which comprises first calculating means for calculating the toner amount for a local area formed by a marked pixel and surrounding pixels per color component data on the bases of the gradation level of each pixel in the local area; second calculating means for calculating the toner amount for the local area with respect to the image data by adding the toner amounts for the local area calculated in the first calculating means for respective colors; third calculating means for calculating the toner amount for a local area indicating the maximum toner amount following the execution of calculations by the first calculating means and the second calculating means in plural local areas with respect to the image data; and determining means for determining a fixing speed for fixing toner on a sheet in accordance with the result of calculation of the thirdly calculating step and the material information of the sheet.

Also, the third calculating means calculates, in the local areas over the image data entirely, the toner amount for the local area indicating the maximum toner amount following the execution of calculations by the first calculating means and the second calculating means.

Also, when the second calculating means calculates the toner amount in the local area, weighting is effectuated per color component.

Also, still another embodiment of the invention is an image processing apparatus for processing binary image data formed by plural color components, which comprises: first calculating means for acquiring the gradation level of each pixel group in a local area formed by a marked pixel and the surrounding pixel groups per color component data to calculate the toner amount for the local area on the bases of the gradation level; second calculating means for calculating the toner amount for the local area with respect to the image data by adding the toner amounts for the local area calculated by the first calculating means for respective colors; third calculating means for calculating the toner amount for a local area indicating the maximum toner amount following the execution of calculations by the first calculating means and the second calculating means in plural local areas with respect to the image data; and determining means for determining a fixing speed for fixing toner on a sheet in accordance with the result of calculation of the third calculating means and the material information of the sheet.

Also, the third calculating means calculates, in the local areas over the image data entirely, the toner amount for the local area indicating the maximum toner amount following the execution of calculations by the first calculating means and the second calculating means in the local area.

Also, when the second calculating means calculates the toner amount in the local area, weighting is effectuated per color component.

Other objects and features of the present invention, besides those discussed above, will be apparent to those skilled in the art from the description of preferred embodiments of the invention described herein and the accompanying drawings, which form a part hereof.

BRIEF DESCRIPTION OF THE DRAWINGS

FIG. 8 is a view that shows one example of a management table with respect to toner amounts—the kinds of sheets.

DETAILED DESCRIPTION OF THE PREFERRED EMBODIMENTS

Hereinafter with reference to the accompanying drawings, the description will be made of the embodiments in accordance with the present invention.

(First Embodiment)

Figure 1:
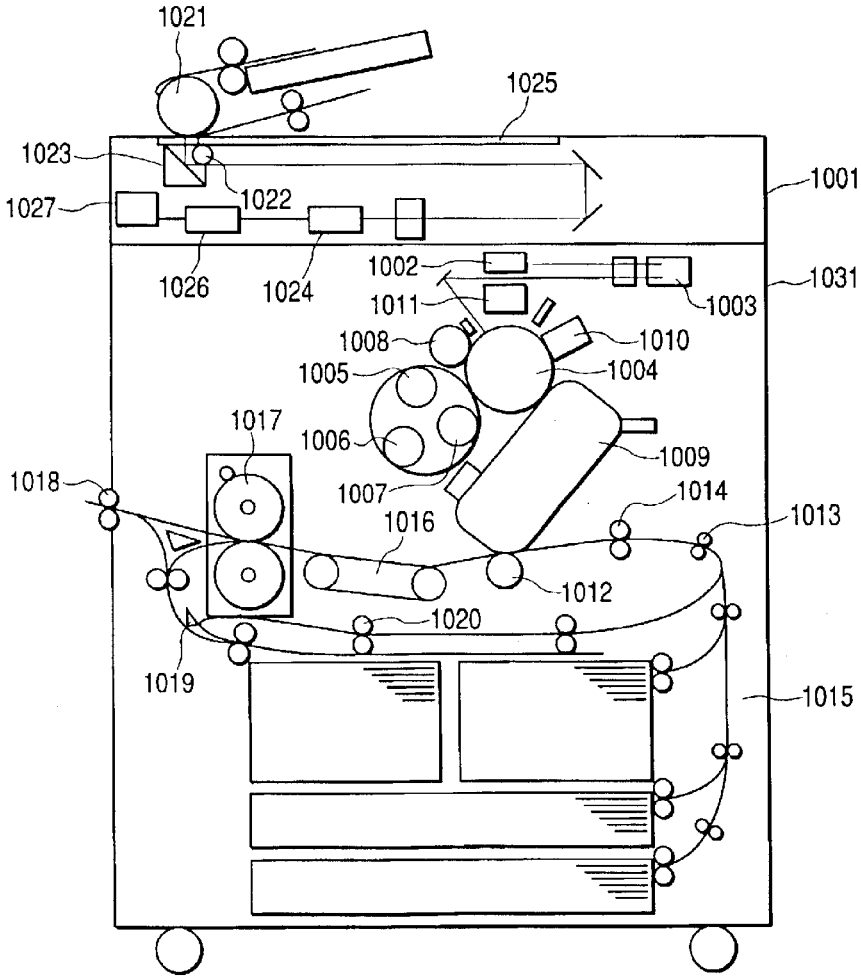
FIG. 1 is a cross-sectional view that schematically shows the structure of an image processing apparatus.

FIG. 1 is across-sectional view that schematically illustrates the structure of an image processing apparatus.

In FIG. 1, a reference numeral 1001 designates an image input unit, such as a digital scanner (image reader), and 1031, an image output unit, such as a printing engine.

In the image input unit 1001, a reference numeral 1021 designates a document feeder, which conveys a source document (original sheet or document sheet); 1022, a light source that illuminates the source document; and 1025, a source document plate on which a source document is set for reading image data.

A reference numeral 1024 designates an image-data reading unit, which is formed by the CCD that converts an optical image into image data, and an analogue processing circuit. A reference numeral 1023 designates a scanner unit formed by the light source 1022 and a mirror, which transfers to the CCD the optical image obtained by scanning the source document set on the source document plate 1025. Also, the image processing apparatus is capable of controlling stream-read of images, that is, the reading of images while conveying the source document by use of a document feeder, retaining the scanner unit 1023 as it is fixed. A reference numeral 1026 designates the image processing circuit with which the image output unit 1031 converts the image data read by the image-data reading unit into the image data used for printing.

A reference numeral 1027 designates a memory, which is capable of accumulating the image data read by the image-data reading unit and the image data to be transferred to the image output unit. Here, for the present embodiment, the image transferred to the image output unit is a multi-valued image data.

In the image output unit 1031, a reference numeral 1002 designates a laser driver that emits a laser light for enabling image data to be exposed for representation, and 1003, a polygonal mirror, which is used for enabling the laser light to scan in the main scanning direction.

A reference numeral 1004 designates a photosensitive drum, which is scanned and exposed by the laser light for the formation of latent image, and 1005, 1006, and 1007, developing devices used for M (magenta), C (cyan), and Y (yellow), respectively, and the developing devices are rotated by use of a stepping motor to be alternately positioned adjacent to the photosensitive drum for development.

A reference numeral 1008 is a developing device for K (black), and 1009, an intermediate transfer belt, and 1010, a cleaner for the photosensitive drum. A reference numeral 1011 designates an electro static charger. In accordance with the present embodiment, the formation of a color image is performed on the photosensitive drum corresponding to each of color-component data. At first, the formation of latent image is executed by means of a laser light corresponding to image data on M. Then, the latent image is developed by use of the M-color developing device, hence effectuating the primary transfer of the toner image developed from the photosensitive drum to the intermediate transfer belt. This series of actions is performed continuously for C, Y, and K, and with four turns of the intermediate transfer belt, the four-color toner images are superposed on the intermediate transfer belt, hence becoming a color toner image.

A reference numeral 1012 designates a secondary transfer roller, which is detachable regarding the intermediate transfer belt 1009. The attachment and detachment thereof is implemented by driving means such a solenoid or a stepping motor. In a state where the secondary transfer roller 1012 is in contact with the intermediate transfer roller 1009, a sheet is conveyed between them in order to effectuate the secondary transfer of the color toner image from the intermediate transfer belt 1009 to the sheet.

A reference numeral 1013 designates a pre-register (or pre-registration) roller, and 1014, a register (or registration) roller. A reference numeral 1015 designates a sheet-feeding unit. The sheet, which has been fed from the sheet-feeding unit, is conveyed to the position of the register roller 1014 using each of the sheet-feeding rollers and the pre-register roller 1013. In the register roller unit, in order that the sheet has a slight loop, the sheet is pressed down by the pre-register roller 1013 to register roller 1014, and then, the conveyance by use of the pre-register roller is suspended. In this manner, the register control is made so as to adjust the position to initiate image representation with respect to the sheet.

Then, in synchronism with the driving of the intermediate transfer belt 1009 and the secondary transfer roller 1012 after the execution of the register control, the register roller 1014 sends the sheet at the portion where the secondary roller 1012 and the intermediate transfer belt 1009 are joined together to execute the secondary transfer to the appropriate position with respect to the sheet.

A reference numeral 1016 designates a conveyer belt, which has many fine openings for causing the adsorption of the sheet to the conveyer belt by means of the force of exhaust air therethrough by use of a fan, and 1017, a fixing unit. The sheet that has passed the secondary transfer unit is conveyed to the fixing unit 1017 by use of the conveyer belt 1016 for fixation.

Subsequent to the fixing, the sheet is expelled from the sheet-expelling unit 1018 outside the apparatus or conveyed to a reversing unit 1019 so that it is conveyed to a double-side re-feeding unit 1020 by means of a switch-back control. The sheet that has been conveyed to the double-side re-feeding unit 1020 is again fed for the execution of printing on the second face (second side or back side) of the double-side print.

The image processing apparatus is structured so as to enable the conveying speeds to be in agreement between the fixing unit 1017 and the conveyer belt 1016, and between the intermediate transfer belt 1009 and the secondary transfer roller 1012 at the time of secondary transfer. Consequently, when the fixing speed is reduced, the conveying speed of the conveying belt 1016, the conveying speeds of the intermediate transfer belt 1009 and the secondary transfer roller 1012 at the time of the secondary transfer are also made slower to the same speed thus reduced.

On the other hand, the speed of the primary transfer, at which each image is drawn on the photosensitive drum 1004, developed, and transferred to the intermediate transfer belt 1009, is always constant and the same as the fixing speed of a plain sheet. In other words, in order to reduce the fixing speed, it is arranged to form an image on the intermediate transfer belt 1009 at an equal speed, at first, and after that, the conveying speeds of the conveyer belt 1016, the intermediate transfer belt 1009 and the second transfer roller 1012 at the time of the secondary transfer are made slower to a speed equal to the fixing speed subsequent to the speed reduction for the performance of the secondary transfer.

In this respect, the present invention can use another structure. In other words, if the conveyer belt 1016 can be provided with an entire length, which is large enough to serve the purpose, it may be possible to arrange a structure so that the process up to the secondary transfer is executed at a speed equal to the fixing speed of a plain sheet, and that only the speed of the conveyer belt is adjusted to watch the fixing speed of the fixing device.

Figure 2:
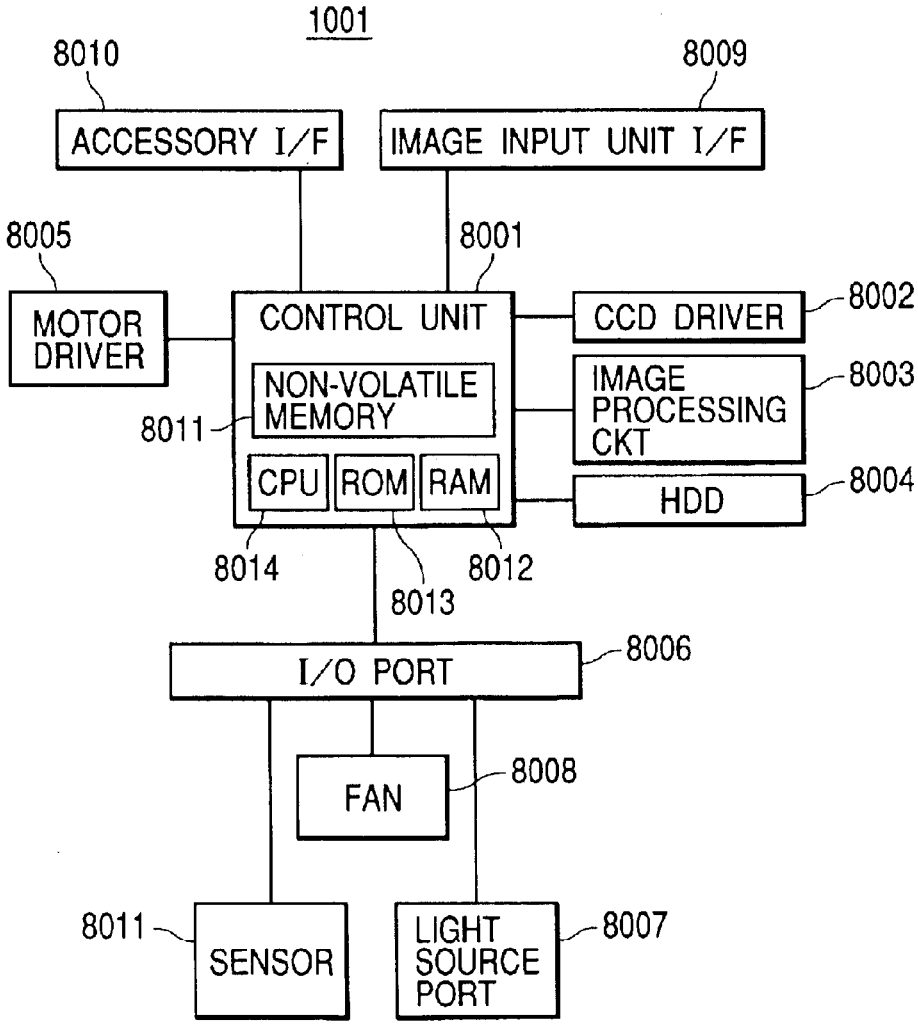
FIG. 2 is a block diagram that shows the structure of a control circuit of an image input unit.

FIG. 2 is a block diagram that illustrates the structure of the control circuit of the image input unit 1001 shown in FIG. 1.

In FIG. 2, a reference numeral 8001 designates the control unit that controls the image input unit. The control unit 8001 is provided with a non-volatile memory 8011; a RAM 8012, which stores variables needed for the execution of a control program required for the operation of the control unit 8001; a ROM 8013, which stores an operational program of the control unit itself; and a CPU 8014, which executes the operational program.

A reference numeral 8002 designates a CCD driver formed by a CCD and an analogue processing circuit; 8003, an image processing circuit; 8004 a memory; 8005, a motor driver to drive the image reading unit to scan; 8006, an I/O port; 8007, a light source port for turning ON/OFF the light source; 8008, various kinds of fans; 8011, various kinds of sensors; 8009, an inter face (image output units I/F) to execute communication with the image output unit 1031; and 8010, an inter face (accessory I/F) that performs communication with the accessory, such as a document feeder.

Figure 3:
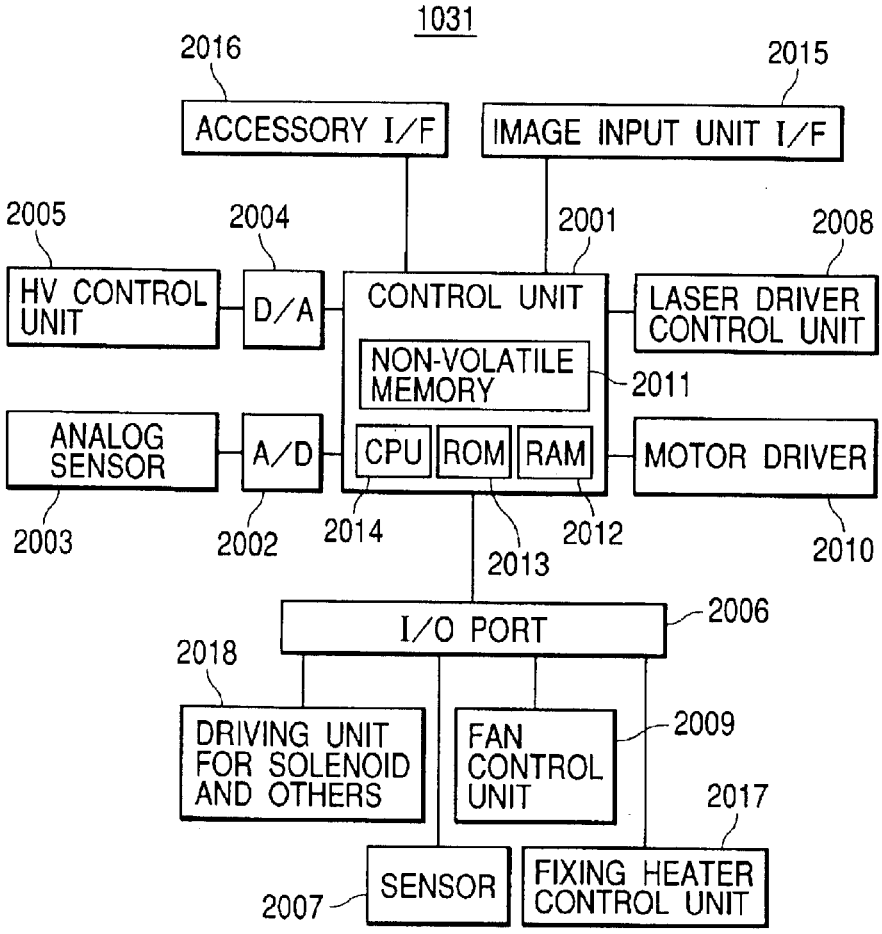
FIG. 3 is a block diagram that shows the structure of a control circuit of an image output unit.

FIG. 3 is a block diagram that illustrates the control configuration of the image output unit 1031 shown in FIG. 1.

In FIG. 3, a reference numeral 2001 designates a control unit that controls the image output unit. The control unit 2001 is provided with a non-volatile memory 2011, and a RAM 2012, which stores variables needed for the execution of a control program required for the operation of the control unit 2001; a ROM 2013, which stores an operational program of the control unit itself; and a CPU 2014, which executes the operational program.

A reference numeral 2002 designates an A/D converter; 2003, various kinds of analogue sensor groups that implement analogue outputs, such as an environmental sensor and a fixing temperature sensor; 2004, a D/A converter; 2005, a high voltage control unit that controls an electro static charger; and 2006, an I/O port.

A reference numeral 2007 designates various kinds of binary output sensor groups, such a sheet position sensor provided for the sheet conveyance passage and a door unit sensor; 2008, a laser driver control unit; 2009, a fan control unit; 2010, various kinds of stepping motor drivers; 2017, a fixing control unit that controls the heater and others of the fixing unit; 2015, a control unit that controls communication with the image input unit (image input unit I/F); 2016, a control unit that controls communication with various kinds of accessories, such as a finisher (accessory I/F); and 2018, other driving units, such as a solenoid.

Figure 4:
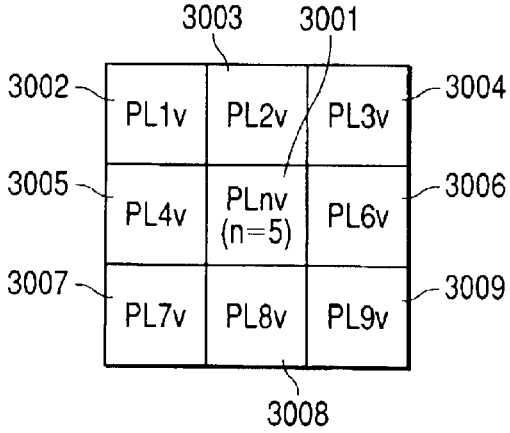
FIG. 4 is a view that shows the characteristics of a color image, which the image processing apparatus is able to output.
Figures 5, 6:
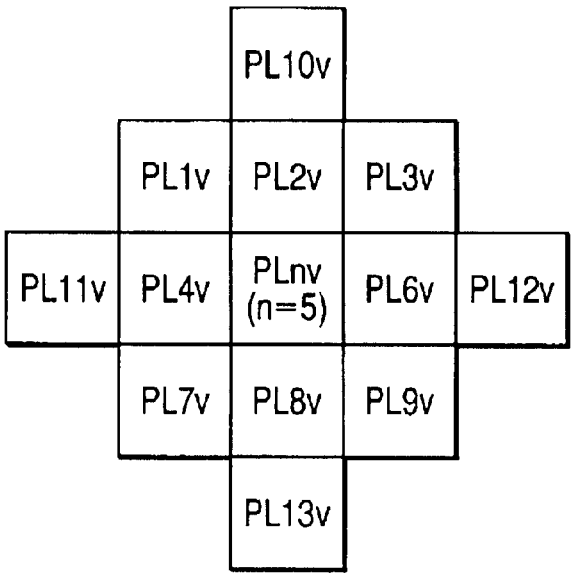
FIG. 5 is a view that shows the characteristics of a color image, which the image processing apparatus is able to output.
FIG. 6 is a view that shows the characteristics of a color image, which the image processing apparatus is able to output.

FIGS. 4 to 6 are views that illustrate the characteristics of a color image that the image processing apparatus of the present invention can output, which indicate local pixel groups each for an arbitral color image.

In FIG. 4, a reference numeral 3001 designates a marked pixcel PLnv (n=5). Here, the n takes a value of 1 to 9, and the drawing indicates the PL5*v* and its surrounding 8 pixels. The v indicates each of the colors M, C, Y, and K. Each color is discriminated by use of the marks M, C, Y, or K. For example, if the representation of the marked pixel (PL5*v*) in FIG. 4 is used, the marked pixel of each color is indicated by PLnM, PLnC, PLnY, or PLnK.

The pixels 3002 to 3009 are the surrounding pixels of the marked pixel 3001, PL1*v*–PL4*v* and PL6*v*–PL9*v*. The pixels 3001 to 3009 are provided with the gradation levels L1*v*–Lnv –L9*v*, respectively. The gradation level of each pixel is compared with a predetermined pixel level Lthv, and then, the number of pixels that become Lnv>Lthv is counted, and the pixels thus counted are made a toner amount TLv for a local pixel group.

Now that the v represents each color of M, C, Y, and K, it is possible to take such structure that the predetermined pixel level is different per color. In this way, it becomes possible to consider the difference of physical property of each of color toners with respect to the fixing thereof. In FIG. 4, the marked pixel and the surrounding 8 pixels form the local pixel group. The toner amount TLv of the local pixel group is indicated by the values [0] to [9].

Here, there is shown an example in which a marked pixel and surrounding 8 pixels form a local pixel group as illustrated in FIG. 4. However, it may be possible to adopt another example in which a marked pixel and surrounding 12 pixels form a local pixel group as shown in FIG. 5 or a still another example in which a marked pixel and surrounding 24 pixels from it as shown in FIG. 6.

Figure 7:
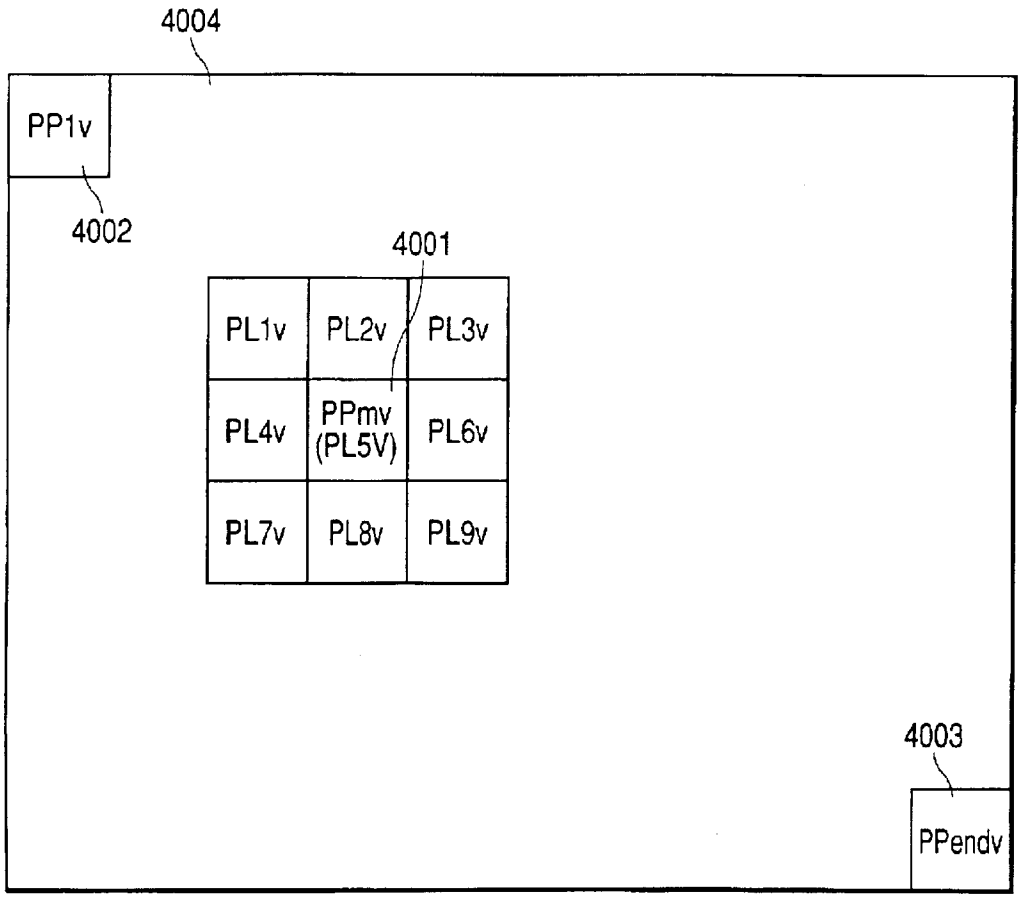
FIG. 7 is a view that shows the configuration of image data of a one-page portion of a image that the image processing apparatus can process.

FIG. 7 is a view that illustrates the structure of image data of a one-page portion of image to be processed by the image processing apparatus embodying the present invention.

In FIG. 7, a reference numeral 4001 designates a marked pixel PPmv. Here, the m takes values 1 to end, and designates each pixel of the one-page portion of image. Also, the v indicates each color of M, C, Y, and K. A reference numeral 4002 designates the pixel PP1*v*, which is the head of image data; 4003, the pixel PPendv, which indicates the end of the image data. The image data are divided into data on each color component (M, C, Y, and K).

A reference numeral 4004 indicates the local pixel group regarding the marked pixel PPmv (the 3×3 matrix structure shown in FIG. 4). Here, per pixel from PP1*v*–PPmv–PPendv, the toner amount TLmv of the local pixel group for image of each color is obtained. The toner amounts thus obtained are defined as the toner amount TLmM, TLmC, TLmY, and TLmK, respectively, for colors of M, C, Y, and K.

In consideration of difference in influences that may be exerted on the fixing due to the difference in the physical property of each toner, the predetermined weight is given to the toner amount of each color. When working out (or calculating) the weight to be given, the weighting coefficients of toners of M, C, Y, and K are defined as w, x, y, and z, respectively. Then, a local color toner amount TLmColor of a specific pixel (m pixel) can be obtained by the following formula:

$$TLm\text{Color}=w\times TLmM+x\times TLmC+y\times TLmY+z\times TLmK$$

Here, the local color toner amount is a value that indicates the sum of the TLmv of toner amount of each color for a specific pixel (pixel m).

Further, in a range from the pixel PP1 that is the head of a one-page portion of the image data to the pixel PPend that is the end thereof, the local color toner amount TLmColor is obtained. Then, of the TL1Color to the TLendColor, the TLmaxColor, which is the maximum value, is given as the local color toner amount that represents this one-page portion of the image data. On the basis of this local color toner amount (TLmaxColor), the fixing speed, which is the fixing condition for fixing toner on a sheet, is controlled.

FIG. 8 is a view that shows one example of a management table of toner amounts for the image processing apparatus embodying the present invention. On the table there are shown data on fixing speeds with respect to the combination of the kinds of transfer sheets and the maximum local color toner amount (TLmaxColor) of the image data.

In FIG. 8, a line designated by reference numerals 5001 to 5003 is represented in three-divided ranges by comparing the maximum local color toner amount TLmaxColor of the image data with two predetermined threshold values TLth1, and TLth2 (here, TLth1<TLth2).

The reference numeral 5001 indicates TLmaxColor< or =TLth1; 5002, TLth1< or =TLmaxColor; and 5003, TLth2<TLmaxColor.

Lines designated by reference numerals 5005 to 5008 indicate the kinds of sheets. The line 5005 is for a plain sheet; 5006, for a board paper (thick paper); 5007, a specially treated paper, such as sealing sheet; and 5008, OHT.

Now, in accordance with the data listed on such management table as shown in FIG. 8, it is possible to determine, for example, that even a board paper (thick paper) can be subjected to the fixing at the speed equal to the fixing speed of a plain paper (at regular speed) if the local color toner amount is worked out to be TLmaxColor<or =TLth1. Also, it is possible to determine that the same board paper (thick paper) can be subjected to the fixing at a ⅔ speed of the fixing speed of the plain paper if it is worked out to be TLth2<TLmaxColor. On the bases of the maximum local toner amount of the image data, which should be recorded on one sheet of recording paper, and the kind of the recording paper, it is possible to determine an optimum fixing condition.

Hereunder, with reference to a flowchart shown in FIG. 9, the description will be made of control process procedures for the image processing apparatus in accordance with the present embodiment.

Figure 9:
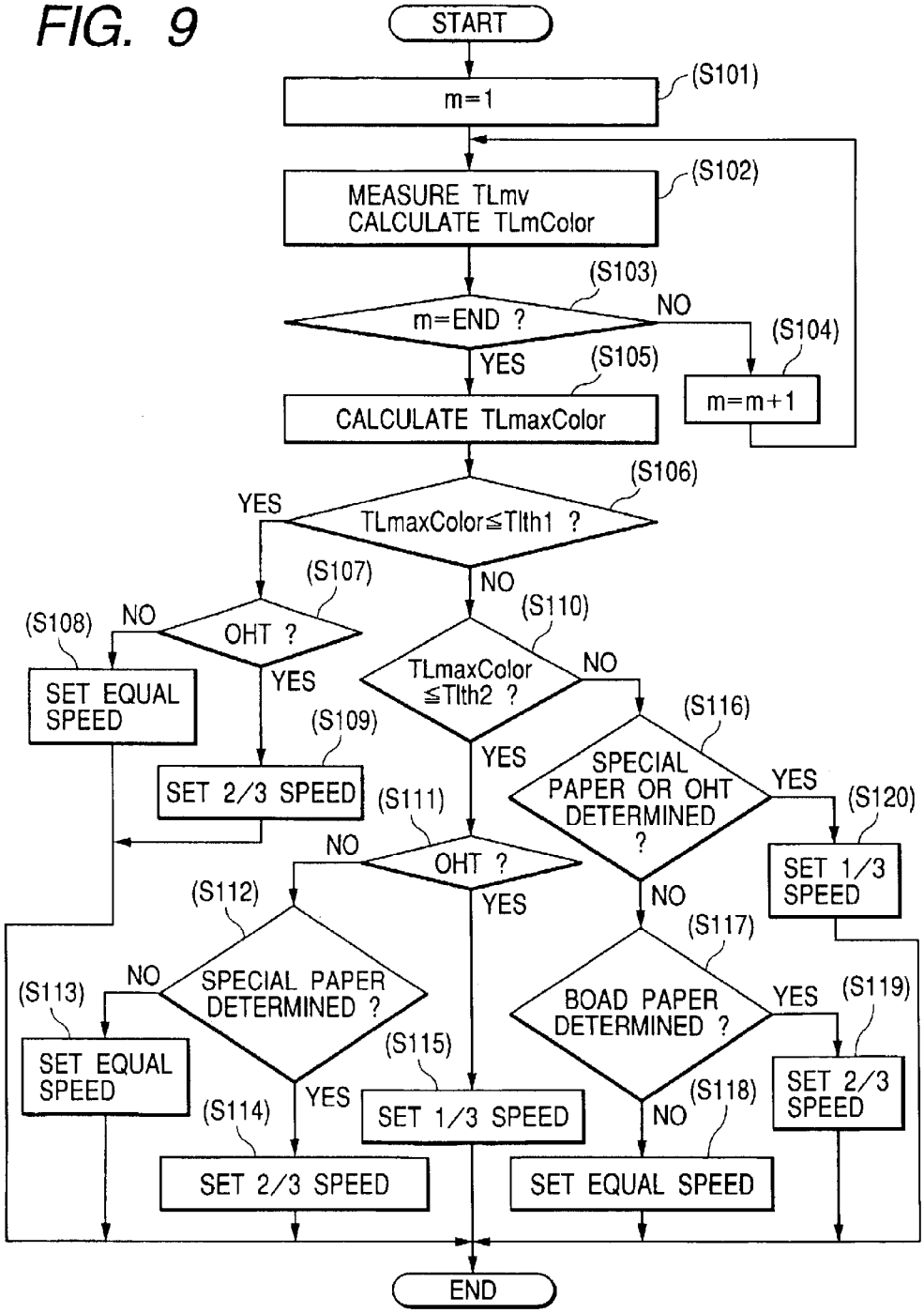
FIG. 9 is a flowchart that shows one example of control process procedures for the image processing apparatus.

FIG. 9 is a flow chart that shows one example of the control process procedures for the image processing apparatus. The control is executed by the CPU 2014 shown in FIG. 3 in accordance with the programs stored on the ROM 2013 and other storages. Also, reference marks S101 to S120 designate steps thereof, respectively.

Here, the processes, which are referred to in the flowchart shown in FIG. 9, may be executed by the CPU 8014 shown in FIG. 2 in accordance with the programs stored on the ROM 8013 and other storages, and then, notified to the image output unit 1031.

At first, 1 is set to the variable m that indicates a marked pixel when image data are inputted from the image input unit I/F 2015 (S101). Then, by the aforesaid method of calculation, the toner amount TLmv is worked out for each color, and further the local color toner amount TLmColor is worked out by the calculation of toner amount TLmv for each color using the predetermined weighting coefficient (S102). After that, it is determined whether or not this calculating process has been finished up to the last pixel on that particular page (S103). If it is negative in the S103, the m is incremented (S104). After the m is incremented in the S104, the process returns to the step S102.

On the other hand, if it is found in the step S103 that the procedure has been taken up to the last pixel on that particular page, the TLmaxColor, which is the maximum value of the local color toner amount for each pixel, is worked out (S105).

Next, the TLmaxColor and the threshold value TLth1 is compared (S106). If it is found that the comparison results in the "TLmaxColor<or =TLth1", it is determined whether or not the medium (the kind of sheet) to which transfer is effectuated is OHT (S107). In the S107, if the medium is found to be OHT, the fixing speed is set at a speed [⅔] of the usual speed (S109), and the process terminates.

On the other hand, if it not found in the step S107 that the medium (the kind of paper), to which transfer is made, is OHT, the fixing speed is set at the usual speed (equal speed) (S108), and the process terminates.

On the other hand, if it is not found in the step S106 that the result of the comparison is "TLmaxColor<or =TLth1", the TLmaxColor is compared with the threshold value TLth2 (provided that the TLth2>TLth1) (S110). Here, if it is found that the "TLmaxColor<or =TLth2", the determination is made as to whether or not the medium (the kind of paper), to which transfer is made, is OHT (S111). Then, if the medium is found to be OHT, the fixing speed is set at a speed [⅓] of the usual speed (S115), and the process terminates.

On the other hand, if it is not found in the step S111 that the medium (the kind of paper), to which transfer is made, is OHT, the determination is made as to whether or not the medium (the kind of paper) is a specially treated paper (S112). If affirmative, the fixing speed is set at a speed [⅔] of the usual speed (S114), and the process terminates.

On the other hand, if it is not found in the step S112 that the medium (the kind of paper), to which transfer is made, is a specially treated paper, the fixing speed is set at the usual speed (S113), and the process terminates.

On the other hand, if it is not found in the step S110 that the result of the comparison is "TLmaxColor<or =TLth2", the determination is made as to whether the medium (the kind of paper), to which transfer is made, is OHT or a specially treated paper (S116). Then, if the medium is found to be OHT or a specially treated paper, the fixing speed is set at a speed [⅓] of the usual speed (S120), and the process terminates.

On the other hand, if it is not found in the step S116 that the medium (the kind of paper) to which transfer is made, is OHT or a specially treated paper, the determination is made as to whether or not the medium (the kind of paper), to which transfer is made, is board paper (thick paper) (S117). Then, if the medium is found to be board paper (thick paper), the fixing speed is set at a speed [⅔] of the usual speed (S119), and the process terminates.

On the other hand, if it not found in the S117 that the medium (the kind of paper), to which tansfer is made, is board paper (thick paper), the fixing speed is set at the usual speed (S118), and the process terminates.

In accordance with the process that has been described above, the fixing speed for fixation on a sheet is determined. Then, the CPU 2014 shown in FIG. 3 controls the image output so that the fixing device 1017 performs the fixing process at the fixing speed thus determined (actually, the rotational speed of the motor driver 2010 is controlled to control the speed at which a medium (a recoding medium such as paper) passes the fixing device 1017).

With the present embodiment structured as has been described above, it becomes possible to secure the same productivity as that of plain sheet even for the transfer paper different from the plain paper, such as board paper (thick paper) and OHT if the target image requires only a small amount of toner locally as in the case of a line drawing. On the other hand, if a target image needs a large amount of toner, the transfer speed is automatically reduced to make it possible to secure a sufficient fixing capability.

(Second Embodiment)

Hereunder, in conjunction with the accompanying drawings, the description will be made of a second embodiment in accordance with the present invention.

Here, for the second embodiment, almost the same structure as the first embodiment is adopted. Therefore, the description of the hardware-structure will be omitted.

The structural difference of the image processing apparatus of the second embodiment from that of the first embodiment is that the image data transmitted from the image input unit to the image output unit is binary image data.

Figure 10:
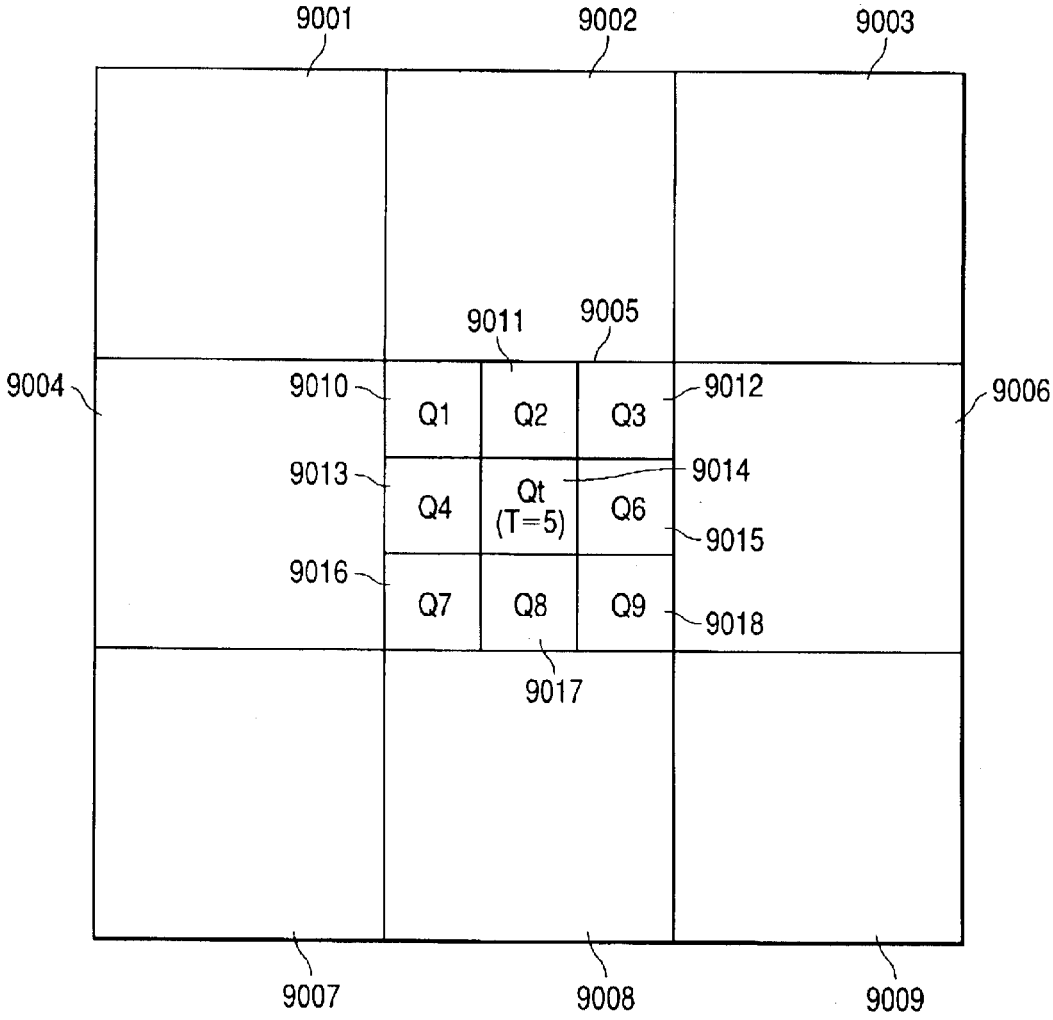
FIG. 10 is a view that shows an example of image processing by the image processing apparatus.

FIG. 10 is a view that illustrates one example of image processing by the image processing apparatus of the second embodiment, which corresponds to the local pixel group for each color.

In FIG. 10, nine image groups 9001 to 9009 form a local pixel group. Here, the pixel groups 9001 to 9009 are assumed to be partial local pixel groups. Further, each of the partial local pixel groups 9001 to 9009 is formed by binary pixels each having the 3×3 matrix formation. Reference numeral 9010 to 9018 designate binary pixels Q1–Qt–Q9 of the partial local pixel group 9005.

In accordance with the second embodiment, the values (0 or 1) of the binary pixels Q1 to Q9 that forms each of the partial local pixel groups are added. Thus added value is dealt with as the pseudo-gradation level Lnv of each partial local pixel group. The pseudo-gradation level Lnv corresponds to the gradation level Lnv of the first embodiment. In other words, since the image processing apparatus of the second embodiment deals with binary image data, the partial local pixel group, which is a partial aggregate of the binary image data, is assumed to be the marked pixel 4001 (in FIG. 7) of the first embodiment. Then, the pseudo-gradation level of each partial local pixel group is dealt with as if the gradation level of the first embodiment, thus working out the toner amount of the partial local pixel group.

Hereunder, means for obtaining the local toner amount TLmaxColor that represents one-page portion of the image dada, and means for determining the fixing speed are structured in the same manner as those of the first embodiment illustrated in FIG. 5 to FIG. 8 and FIG. 9. Therefore, the detailed description thereof will be omitted. With the present embodiment, which is adopted as described above, it becomes possible to provide an image processing apparatus capable of processing binary image data.

Also, for the two embodiments described above, the description has been made of the structure to control the fixing process at the fixing speed, which is determined in such a way that the maximum local toner amount is obtained for the image data read out from a source document by the image input device, the required maximum local toner amount is worked out, and then, the fixing speed of the fixing device is determined on the basis of such maximum local toner amount thus obtained and the kind of paper to be used. However, the present invention is applicable to the image data that may be inputted from a host computer or the like.

The present invention is not necessarily limited to the embodiments described above. It is to be understood that various modifications can be made on the basis of the purport of the present invention, and that such modifications are not excluded from the scope of the present invention.

Also, it is to be understood that the structure in which the first and second embodiments described above are combined is included in the present invention.

Hereunder, with reference to a memory map shown in FIG. 11, the description will be made of the structure of a data processing program readable in the image processing apparatus of the present invention.

Figure 11:
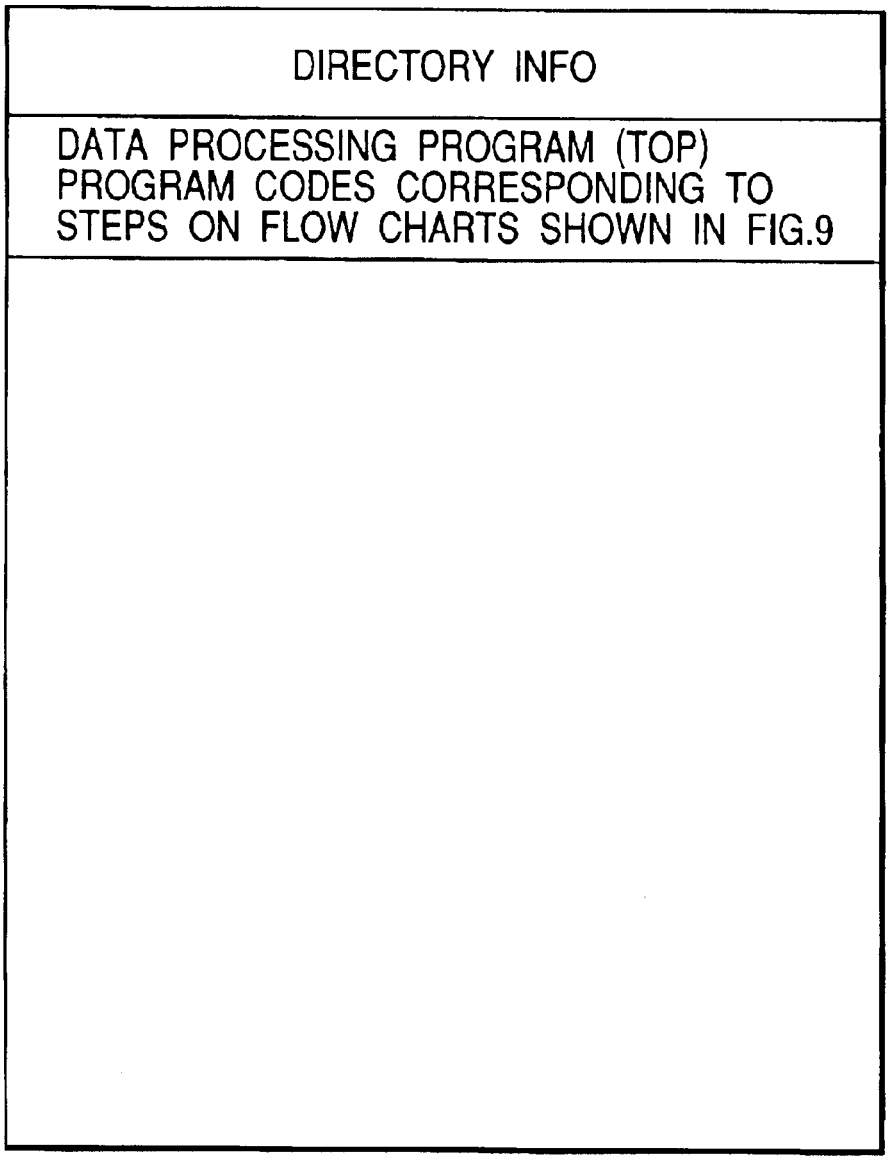
FIG. 11 is a view that shows a memory map of storage media for storing various data processing programs readable by the image processing apparatus.

FIG. 11 is a view that illustrates the memory map of a storage that stores various kinds of data processing programs readable in the image processing apparatus of the present invention.

In this respect, although not particularly shown, the information that manages program groups stored on the storage, such as information regarding version and program creator, are also stored. Also, information, such as icons, that indicate identifications of programs, which depends on an OS at a program read-out side, may be stored in some cases.

Further, data that belong to various programs are managed by such directory information as described above. Also, when programs and data to be installed are compressed, a program or the like for decompressing them may be stored in some cases.

It may also be possible to execute the functions shown in FIG. 9 for the present embodiment by a host computer in accordance with a program installed from the external. In such a case, too, the present invention is applicable when the groups of information that contain programs are supplied to an output device from a storage medium, such as a CD-ROM, a flesh memory, or a FD, or from the external storage by way of a network.

As described above, it is of course possible to achieve the objects of the present invention by providing the storage that stores programming codes of a software to materialize the functions of the aforesaid embodiment for a system or an apparatus, and reading out the stored programming codes stored in the storage by the computer (or CPU or MPU) of such system or apparatus reads out for execution.

In this case, it is to be understood that the programming codes thus read out from the storage materialize new functions of the present invention, and that the storage that stores such programming codes constitutes the present invention.

As a storage that supplies programming codes, it is possible to use a floppy (registered trade mark) disk, a hard disk, an optical disk, an opto-magnetic disk, a CD-ROM, a CD-R, a DVD-ROM, a magnetic tape, a non-volatile memory card, a ROM, an EEPROM, and a silicon disk, among some others.

Also, not only it is possible to materialize the functions of the aforesaid embodiment by the execution of the programming codes read out by the computer, but also, it is possible for the OS (operating system) that operates on a computer or the like to execute a part or all of the actual processes thereby to materialize the functions of the aforesaid embodiment. Such a case is of course included in the present invention, too.

Further, programming codes thus read out from a storage are written onto the storage provided for an expanded functional board inserted into a computer or an expanded functional unit connected to a computer, and after that, a CPU or the like installed on such functional board or expanded functional unit executes a part or all of the actual process in accordance with the instructions of such programming codes. The present invention of course includes such a case where the functions of the aforesaid embodiment are materialized by means of this process.

Also, the present invention may be applicable to a system formed by plural equipments or to an apparatus formed by a single equipment. Also, the present invention is of course applicable to a case where programs are supplied to a system or an apparatus for the attainment of the objects thereof. In this case, the effects produced by the present invention can benefit the system or the apparatus when the system or the apparatus reads out the software programs, which are stored on storage, for the attainment of the present invention.

Further, it becomes possible for the present invention to benefit a system or an apparatus by the effects thereof when the system or the apparatus reads out the software programs for the attainment of the present invention by means of download from a data base on a network using a communication program.

As has been described above, in accordance with the present invention, it is possible to enhance the printing productivity of paper sheet other than a usual plain sheet, such as a board paper (a thick paper) or OHT if an image uses a small amount of toner, while effectively performing the image processing for which different influences exerted on fixation are taken into consideration per color toner in terms of the local toner amount.

Also, in a case of the image that uses a small amount of toner, not only the printing productivity can be enhanced for the paper sheet other than a usual plain sheet, such as a board paper (a thick paper) or OHT, but also, the image processing can be performed effectively, for which different influences exerted on fixation are taken into consider per color toner.

Consequently, in consideration of the toner influence per color, and the local toner amount within an image, a sufficient fixing capability is secured by reducing the fixing speed if the image needs a large amount of toner on one hand, but in a case of an image that uses a small amount of toner, it is possible for the present invention to produce effects on the enhancement of printing productivity, on the other hand, for the sheets other than the plain paper, such as a board paper (a thick paper) or OHT, while securing the fixing capability sufficiently.

What is claimed is:

1. An image processing apparatus for processing image data formed by plural color components comprising:

first calculating means for calculating the toner amount for a local area formed by a marked pixel and surrounding pixels per color component data;

second calculating means for calculating the toner amount for the local area with respect to said image data by adding the toner amounts for the local area calculated by said first calculating means for respective colors;

third calculating means for calculating the toner amount for a local area indicating the maximum toner amount following the execution of calculations by said first calculating means and said second calculating means in plural local areas with respect to said image data; and determining means for determining a fixing speed for fixing toner on a sheet in accordance with the result of calculation of said third calculating means.

2. An image processing apparatus according to claim 1, wherein in the local areas over said image data entirely, said third calculating means calculates the toner amount for the local area indicating the maximum toner amount following the execution of calculations by said first calculating means and said second calculating means.

3. An image processing apparatus according to claim 2, wherein when said second calculating means calculates the toner amount in the local area, weighting is effectuated per color component.

4. An image processing apparatus according to claim 2, wherein said local area is formed by a pixel group of N×N matrix structure.

5. An image processing apparatus according to claim 4, wherein said local area is formed by a pixel group of 3×3 matrix structure.

6. An image processing apparatus according to claim 4, wherein said local area is formed by a pixel group of 5×5 matrix structure.

7. An image processing apparatus according to claim 2, wherein said local area is formed by a pixel group of 3×3 matrix structure, and pixels each adjacent to the outer side of the central pixel on each side of the pixel group.

8. An image processing apparatus for processing image data formed by plural color components comprising:

first calculating means for calculating the toner amount for a local area formed by a marked pixel and surrounding pixels per color component data;

second calculating means for calculating the toner amount for the local area with respect to said image data by adding the toner amounts for the local area calculated by said first calculating means for respective colors;

third calculating means for calculating the toner amount for a local area indicating the maximum toner amount following the execution of calculations by said first calculating means and said second calculating means in plural local areas with respect to said image data; and determining means for determining a fixing speed for fixing toner on a sheet in accordance with the result of calculation of said third calculating means and the material information of the sheet.

9. An image processing apparatus according to claim 8, wherein in the local areas over said image data entirely, said third calculating means calculates the toner amount for the local area indicating the maximum toner amount following the execution of said first calculating means and said second calculating means.

10. An image processing apparatus according to claim 9, wherein when said second calculating means calculates the toner amount in the local area, weighting is effectuated per color component.

11. An image processing apparatus according to claim 9, wherein said local area is formed by a pixel group of N×N matrix structure.

12. An image processing apparatus according to claim 11, wherein said local area is formed by a pixel group of 3×3 matrix structure.

13. An image processing apparatus according to claim 11, wherein said local area is formed by a pixel group of 5×5 matrix structure.

14. An image processing apparatus according to claim 9, wherein said local area is formed by a pixel group of 3×3 matrix structure, and pixels each adjacent to the outer side of the central pixel on each side of the pixel group.

15. An image processing apparatus for processing multi-valued image data formed by plural color components comprising:

first calculating means for calculating the toner amount for a local area formed by a marked pixel and surrounding pixels on the bases of the gradation level of each pixel in the local area;

second calculating means for calculating the toner amount for the local area with respect to said image data by adding the toner amounts for the local area calculated by said first calculating means for respective colors;

third calculating means for calculating the toner amount for a local area indicating the maximum toner amount following the execution of calculations by said first calculating means and said second calculating means in plural local areas with respect to said image data; and determining means for determining a fixing speed for fixing toner on a sheet in accordance with the result of calculation of said third calculating means and the material information of the sheet.

16. An image processing apparatus according to claim 15, wherein in the local areas over said image data entirely, said third calculating means calculates the toner amount for the local area indicating the maximum toner amount following the execution of calculations by said first calculating means and said second calculating means.

17. An image processing apparatus according to claim 16, wherein when said second calculating means calculates the toner amount in the local area, weighting is effectuated per color component.

18. An image processing apparatus according to claim 16, wherein said local area is formed by a pixel group of N×N matrix structure.

19. An image processing apparatus for processing binary image data formed by plural color components comprising:

first calculating means for acquiring the gradation level of each pixel group in a local area formed by a marked pixel and the surrounding pixel groups per color component data to calculate the toner amount for the local area on the bases of said gradation level;

second calculating means for calculating the toner amount for the local area with respect to said image data by adding the toner amounts for the local area calculated by said first calculating means for respective colors;

third calculating means for calculating the toner amount for a local area indicating the maximum toner amount following the execution of calculations by said first calculating means and said second calculating means in plural local areas with respect to said image data; and determining means for determining a fixing speed for fixing toner on a sheet in accordance with the result of calculation of said third calculating means and the material information of the sheet.

20. An image processing apparatus according to claim 19, wherein in the local areas over said image data entirely, said third calculating means calculates the toner amount for the local area indicating the maximum toner amount following the execution of calculations by said first calculating means and said second calculating means.

21. An image processing apparatus according to claim 20, wherein when said second calculating means calculates the toner amount in the local area, weighting is effectuated per color component.

22. An image processing apparatus according to claim 20, wherein said local area is formed by a pixel group of N×N matrix structure.

23. An image processing method for processing image data formed by plural color components comprising the following steps of:

firstly, calculating the toner amount for a local area formed by a marked pixel and surrounding pixels per color component data;

secondly, calculating the toner amount for the local area with respect to said image data by adding the toner amounts for the local area calculated in said firstly calculating step for respective colors;

thirdly, calculating the toner amount for a local area indicating the maximum toner amount following the execution of calculations by said firstly calculating step and said secondly calculating step in plural local areas with respect to said image data; and determining a fixing speed for fixing toner on a sheet in accordance with the result of calculation in said thirdly calculating step.

24. An image processing method according to claim 23, wherein in the local areas over said image data entirely, said thirdly calculating step calculates the toner amount for the local area indicating the maximum toner amount following the execution of calculations by said firstly calculating step and said secondly calculating step.

25. An image processing method according to claim 24, wherein when said secondly calculating step calculates the toner amount in the local area, weighting is effectuated per color component.

26. An image processing method for processing image data formed by plural color components comprising the following steps of:

firstly, calculating the toner amount for a local area formed by a marked pixel and surrounding pixels per color component data;

secondly, calculating the toner amount for the local area with respect to said image data by adding the toner amounts for the local area calculated in said firstly calculating step for respective colors;

thirdly, calculating the toner amount for a local area indicating the maximum toner amount following the execution of calculations by said firstly calculating step and said secondly calculating step in plural local areas with respect to said image data; and determining a fixing speed for fixing toner on a sheet in accordance with the result of calculation of said thirdly calculating step and the material information of the sheet.

27. An image processing method according to claim 26, wherein in the local areas over said image data entirely, said thirdly calculating step calculates the toner amount for the local area indicating the maximum toner amount following the execution of calculations by said firstly calculating step and said secondly calculating step.

28. An image processing method according to claim 27, wherein when said secondly calculating step calculates the toner amount in the local area, weighting is effectuated per color component.

29. An image processing method for processing multi-valued image data formed by plural color components comprising the following steps of:

firstly, calculating the toner amount for a local area formed by a marked pixel and surrounding pixels per color component data on the bases of the gradation level of each pixel;

secondly, calculating the toner amount for the local area with respect to said image data by adding the toner amounts for the local area calculated in said firstly calculating step for respective colors;

thirdly, calculating the toner amount for a local area indicating the maximum toner amount following the execution of calculations by said firstly calculating step and said secondly calculating step in plural local areas with respect to said image data; and determining a fixing speed for fixing toner on a sheet in accordance with the result of calculation of said thirdly calculating step and the material information of the sheet.

30. An image processing method according to claim 29, wherein in the local areas over said image data entirely, said thirdly calculating step calculates the toner amount for the local area indicating the maximum toner amount following the execution of calculations by said firstly calculating step and said secondly calculating step.

31. An image processing method according to claim 30, wherein when said secondly calculating step calculates the toner amount in the local area, weighting is effectuated per color component.

32. An image processing method for processing binary image data formed by plural color components comprising the following steps of:

firstly, acquiring the gradation level of each pixel group in the local area formed by a marked pixel and the surrounding pixel groups per color component data, and calculating the toner amount on the basis of said gradation level;

secondly, calculating the toner amount for the local area with respect to said image data by adding the toner amounts for the local areas calculated in said firstly calculating step for respective colors;

thirdly, calculating the toner amount for a local area indicating the maximum toner amount following the execution of calculations by said firstly calculating step and said secondly calculating step in plural local areas with respect to said image data; and determining a fixing speed for fixing toner on a sheet in accordance with the result of calculation of said thirdly calculating step and the material information of the sheet.

33. An image processing method according to claim 32, wherein in the local areas over said image data entirely, said thirdly calculating step calculates the toner amount for the local area indicating the maximum toner amount following the execution of calculations by said firstly calculating step and said secondly calculating step.

34. An image processing method according to claim 33, wherein when said secondly calculating step calculates the toner amount in the local area, weighting is effectuated per color component.

35. An image forming apparatus provided with fixing means having at least two switchable fixing speeds, said apparatus comprising:

first calculating means for calculating a toner amount in units of plural pixel groups regarding one page of image;

second calculating means for calculating a local toner amount representative of image data of said one page of image from a plurality of the toner amounts calculated by said first calculating means;

determining means for determining a fixing speed in accordance with the local toner amount calculated by said second calculating means; and control means for controlling said fixing means to perform a fixing process at the determined fixing speed.

36. An image forming method for an image forming apparatus provided with fixing means having at least two switchable fixing speeds, said method comprising:

a first calculating step for calculating a toner amount in units of plural pixel groups regarding one page of image;

a second calculating step for calculating a local toner amount representative of image data of said one page of image from a plurality of the toner amounts calculated in said first calculating step;

a determining step for determining a fixing speed in accordance with the local toner amount calculated in said second calculating step; and a control step for controlling said fixing step to perform a fixing process at the determined fixing speed.

* * * * *

UNITED STATES PATENT AND TRADEMARK OFFICE

CERTIFICATE OF CORRECTION

PATENT NO. : 6,898,387 B2
DATED : May 24, 2005
INVENTOR(S) : Takuya Kawamura

It is certified that error appears in the above-identified patent and that said Letters Patent is hereby corrected as shown below:

Column 2,
Line 28, “preset” should read -- present --.

Column 5,
Line 2, “amounts—the” should read -- amounts and the --.
Line 65, “electro static” should read -- electrostatic --.

Column 7,
Lines 36 and 38, “inter face” should read -- interface --.
Line 55, “electro static” should read -- electrostatic --.

Column 8,
Line 3, “arbitral” should read -- arbitrary --.
Line 5, “pixcel” should read -- pixel --.

Column 10,
Line 6, “is” should read -- are --.

Column 11,
Line 29, “forms” should read -- form --.

Column 12,
Line 29, “flesh” should read -- flash --.

Signed and Sealed this

Thirteenth Day of September, 2005

JON W. DUDAS
*Director of the United States Patent and Trademark Office*